US008328347B2

(12) United States Patent
Mitsuzawa

(10) Patent No.: US 8,328,347 B2
(45) Date of Patent: Dec. 11, 2012

(54) PRINTING APPARATUS AND PRINTING METHOD

(75) Inventor: Toyohiko Mitsuzawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 162 days.

(21) Appl. No.: 12/889,964

(22) Filed: Sep. 24, 2010

(65) Prior Publication Data

US 2011/0074857 A1 Mar. 31, 2011

(30) Foreign Application Priority Data

Sep. 30, 2009 (JP) ..... 2009-228060

(51) Int. Cl.
*B41J 2/01* (2006.01)

(52) U.S. Cl. ..... 347/102; 347/101

(58) Field of Classification Search ..... None
See application file for complete search history.

(56) References Cited

U.S. PATENT DOCUMENTS 8,123,346 B2 * 2/2012 Ohnishi et al. ..... 347/102
2006/0290760 A1 * 12/2006 German et al. ..... 347/102

FOREIGN PATENT DOCUMENTS

JP 2000-158793 6/2000

* cited by examiner

*Primary Examiner* — Geoffrey Mruk

(57) ABSTRACT

A printing apparatus including: a head that ejects an electromagnetic wave curable ink on a medium; an irradiation section that irradiates electromagnetic waves on the electromagnetic wave curable ink which is ejected onto the medium by the head, so that it provisionally cures the electromagnetic wave curable ink; and a controller that controls the irradiation section so as to cause the irradiation section to perform an irradiating operation that irradiates electromagnetic waves to the electromagnetic wave curable ink on the medium.

10 Claims, 7 Drawing Sheets

| PRINTING MODE | IRRADIATION AMOUNT | CARRIAGE MOVING VELOCITY |
|---|---|---|
| LOW GLOSS PRINTING MODE (PAPER) | HIGH IRRADIATION AMOUNT $Rh_2 \rightarrow Rh_1$ | HIGH SPEED Vh |
| LOW GLOSS PRINTING MODE (FILM) | HIGH IRRADIATION AMOUNT $Rh_1 \rightarrow Rh_2$ | HIGH SPEED Vh |
| HIGH GLOSS PRINTING MODE (PAPER) | LOW IRRADIATION AMOUNT $Rl_2 \rightarrow Rl_1$ | LOW SPEED Vl |
| HIGH GLOSS PRINTING MODE (FILM) | LOW IRRADIATION AMOUNT $Rl_1 \rightarrow Rl_2$ | LOW SPEED Vl |

FIG. 5

| PRINTING MODE | IRRADIATION AMOUNT | CARRIAGE MOVING VELOCITY |
|---|---|---|
| LOW GLOSS PRINTING MODE (PAPER) | HIGH IRRADIATION AMOUNT $Rh_2 \rightarrow Rh_1$ | HIGH SPEED Vh |
| LOW GLOSS PRINTING MODE (FILM) | HIGH IRRADIATION AMOUNT $Rh_1 \rightarrow Rh_2$ | HIGH SPEED Vh |
| HIGH GLOSS PRINTING MODE (PAPER) | LOW IRRADIATION AMOUNT $Rl_2 \rightarrow Rl_1$ | LOW SPEED Vl |
| HIGH GLOSS PRINTING MODE (FILM) | LOW IRRADIATION AMOUNT $Rl_1 \rightarrow Rl_2$ | LOW SPEED Vl |

PRINTING APPARATUS AND PRINTING METHOD

CROSS-REFERENCE TO RELATED APPLICATION

Japanese Patent Application No. 2009-228060 is hereby incorporated by reference in its entirety.

BACKGROUND

1. Field of Invention

The present invention relates to a printing apparatus and a printing method.

2. Description of Related Art

A representative example of the printing apparatus having a head that ejects ink to a medium is well known in the art. As the printing apparatus, an ink jet printer is known in which the printer ejects the ink onto various media such as paper, film or the like so as to perform printing. Also, one of the printing apparatus uses electromagnetic wave curable ink that is cured when electromagnetic waves such as ultraviolet or the like are irradiated, and the printing apparatus has an irradiation section that irradiates electromagnetic waves on the electromagnetic wave curable ink which has been ejected onto the medium by the head so as to provisionally cure the electromagnetic wave curable ink.

JP-A-2000-158793 is an example of related art.

However, a degradation of the image quality may be occurred when the printing image is obtained by the printing apparatus. For example, so-called bleed phenomenon (permeation of the ink) occurs in some case. Also, a phenomenon that the dot diameter or line width becomes too small occurs as well. Thus, there is need to suppress the degradation.

SUMMARY OF INVENTION

An advantage of some aspects of the invention is that it provides a printing apparatus and a printing method to suppress the degradation of the quality of the image.

According to an aspect of the invention, there is provide a printing apparatus including: a head that ejects an electromagnetic wave curable ink on a medium; an irradiation section that irradiates electromagnetic waves on the electromagnetic wave curable ink which is ejected onto the medium by the head, so that it provisionally cures the electromagnetic wave curable ink; and a controller that controls the irradiation section so as to cause the irradiation section to perform an irradiating operation that irradiates electromagnetic waves to the electromagnetic wave curable ink on the medium, wherein in the case where the medium is a first medium, the controller causes the irradiation section to perform the irradiating operation so that the irradiation amount per unit time of the electromagnetic waves to be irradiated on the electromagnetic wave curable ink by the irradiation section becomes a first irradiation amount, then causes the irradiation section to perform the irradiating operation so that the irradiation amount becomes a second irradiation amount which is smaller than the first irradiation amount and, wherein in the case where that the medium is a second medium, the controller causes the irradiation section to perform the irradiating operation so that the irradiation amount becomes a third irradiation amount, then causes the irradiation section to perform the irradiating operation so that the irradiation amount becomes a fourth irradiation amount which is larger than the third irradiation amount.

Other characteristics of the invention are clarified by the specification and annexed drawings.

BRIEF DESCRIPTION OF THE DRAWINGS

The invention will be described with reference to the accompanying drawings, wherein like numbers reference like elements.

FIG. 5 is a view showing the relationship among a printing mode, an irradiation amount and a carriage moving velocity.

DESCRIPTION OF THE PREFERRED EMBODIMENTS

Figure 1:
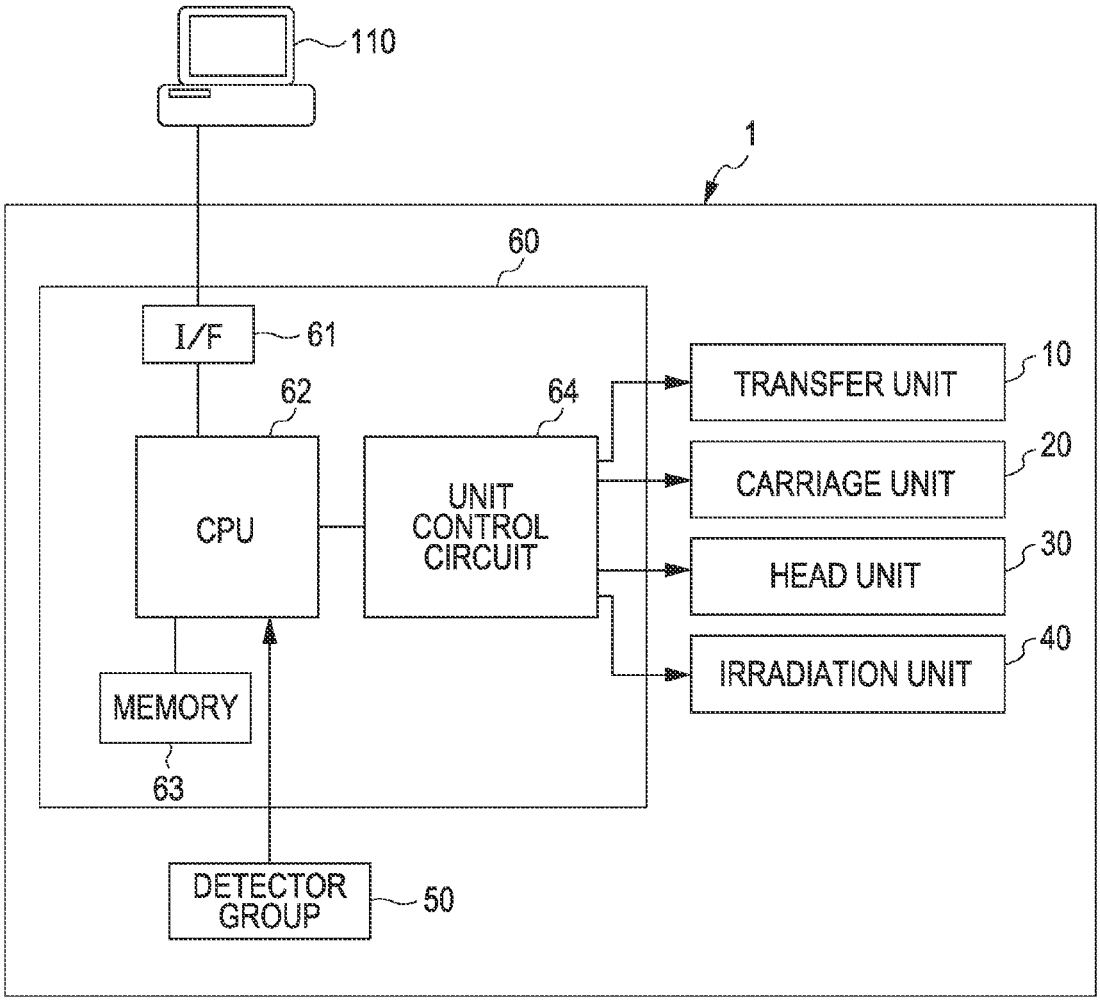
FIG. 1 is a block diagram showing constitution of a printer.

At least following characteristic is cleared by the specification and annexed drawings.

There is provided a printing apparatus including: a head that ejects an electromagnetic wave curable ink onto a medium; an irradiation section that irradiates electromagnetic waves on the electromagnetic wave curable ink which is ejected onto the medium by the head, so that it provisionally cures the electromagnetic wave curable ink; and a controller that controls the irradiation section so as to cause the irradiation section to perform an irradiating operation that irradiates electromagnetic waves to the electromagnetic wave curable ink on the medium, wherein in the case where the medium is a first medium, the controller causes the irradiation section to perform the irradiating operation so that the irradiation amount per unit time of the electromagnetic waves to be irradiated on the electromagnetic wave curable ink by the irradiation section becomes a first irradiation amount, then causes the irradiation section to perform the irradiating operation so that the irradiation amount becomes a second irradiation amount which is smaller than the first irradiation amount and, wherein in the case where that the medium is a second medium, the controller causes the irradiation section to perform the irradiating operation so that the irradiation amount becomes a third irradiation amount, then causes the irradiation section to perform the irradiating operation so that the irradiation amount becomes a fourth irradiation amount which is larger than the third irradiation amount.

According to the aspect of the invention, it is possible to suitably suppress degradation of the quality of the image.

In the apparatus, the apparatus further including a movement device that relatively moves the irradiation section in the movement direction to the medium, wherein the irradiation section has a first irradiation section and a second irradiation section which are provided along the movement direction, wherein the controller controls the irradiation section and the movement device, so as to cause the irradiation section to relatively move in the movement direction to the medium, while causing the irradiation section to perform the irradiating operation, and wherein by making the intensity of the electromagnetic waves which are emitted by the irradiation section in the case where the medium is the first medium to be different from that in the case where the medium is the second medium, in the case where the medium is the first medium, the controller causes the first irradiation section to perform the irradiating operation so that the irradiation amount becomes the first irradiation amount, then causes the second irradiation section to perform the irradiating operation so that the irradiation amount becomes the second irradiation amount and in the case where the medium is the second medium, the controller causes the first irradiation section to perform the irradiating operation so that the irradiation amount becomes the third irradiation amount, then causes the second irradiation section to perform the irradiating operation so that the irradiation amount becomes the fourth amount.

According to the aspect of the invention, it is possible to simplify the peripheral device of the irradiation section.

In the apparatus, the irradiation section has a movement device that relatively moves the irradiation section in the movement direction to the medium, wherein the irradiation section has a first irradiation section and a second irradiation section which are provided along the movement direction, wherein the controller controls the irradiation section and the movement device, so as to cause the irradiation section to relatively move in the movement direction to the medium, while causing the irradiation section to perform the irradiating operation, and wherein by making the distance between the irradiation section and the medium in the case where the medium is the first medium to be different from that in the case where the medium is the second medium, in the case where the medium is the first medium, the controller causes the first irradiation section to perform the irradiating operation so that the irradiation amount becomes the first amount, then causes the second irradiation section to perform the irradiating operation so that the irradiation amount becomes the second irradiation amount, and in the case where the medium is the second medium, the controller causes the first irradiation section to perform the irradiating operation so that the irradiation amount becomes the third irradiation amount, then causes the second irradiation section to perform the irradiating operation so that the irradiation amount becomes the fourth irradiation amount.

According to the aspect of the invention, it is possible to use a simple member as the irradiation section.

In the apparatus, the controller makes the distance between the first irradiation section and the second irradiation section in the movement direction in the case where the medium is the first medium to be different from that in the case where the mediums is the second medium.

According to the aspect of the invention, it is possible to produce proper an appropriate glossiness on the printing image.

In the apparatus, the apparatus further including a movement device that relatively moves the irradiation section in the movement direction to the medium, wherein the controller controls the irradiation section and the movement device so as to cause the irradiation section to relatively move in the movement direction to the medium, while causing the irradiation section to perform the irradiating operation, and wherein by changing the incline of the irradiation section and making the direction of the electromagnetic waves emitted from the irradiation section in the case where the medium is the first medium to be different from that in the case where the medium is the second medium, in the case where the medium is the first medium, the controller causes the irradiation section to perform the irradiating operation so that the irradiation amount becomes the first amount, then causes the irradiation section to perform the irradiating operation so that the irradiation amount becomes the second irradiation amount, and in the case where the medium is the second medium the controller causes the irradiation section to perform the irradiating operation so that the irradiation amount becomes the third irradiation amount, then causes the irradiation section to perform the irradiating operation so that the irradiation amount becomes the fourth irradiation amount.

According to the aspect of the invention, only one irradiation section is sufficient without providing a plurality of the separate irradiation sections.

In the apparatus, the apparatus further includes a movement device that relatively moves the irradiation section to the medium, wherein the controller controls the irradiation section and the movement device so as to cause the irradiation section to relatively move to the medium, while causing the irradiation section to perform the irradiating operation, and wherein both the irradiation amount and the relative moving velocity when the irradiation section is relatively moved to the medium are changed so that glossiness of the printing image is to be different, and thus a plurality of printing modes having different glossiness is performed.

According to the aspect of the invention, it is possible to realize easily and appropriately printing images having different glossiness.

There is provide a printing method including: preparing a printing apparatus having a head that ejects an electromagnetic wave curable ink on a medium, an irradiation section that irradiates electromagnetic waves on the electromagnetic wave curable ink which is ejected onto the medium by the head, so that it provisionally cures the electromagnetic wave curable ink, and a controller that controls the irradiation section so as to cause the irradiation section to perform an irradiating operation that irradiates electromagnetic waves to the electromagnetic wave curable ink on the medium; in the case where the medium is a first medium, causing the irradiation section to perform the irradiating operation so that the irradiation amount per unit time of the electromagnetic waves to be irradiated on the electromagnetic wave curable ink by the irradiation section becomes a first irradiation amount, then causing the irradiation section to perform the irradiating operation so that the irradiation amount becomes a second irradiation amount which is smaller than the first irradiation amount; and in the case where that the medium is a second medium, causing the irradiation section to perform the irradiating operation so that the irradiation amount becomes a third irradiation amount, then causing the irradiation section to perform the irradiating operation so that the irradiation amount becomes a fourth irradiation amount which is larger than the third irradiation amount.

According to the aspect of the invention, it is possible to appropriately suppress the degradation of the quality of the image.

Summary of the Printer 1

Figure 2:
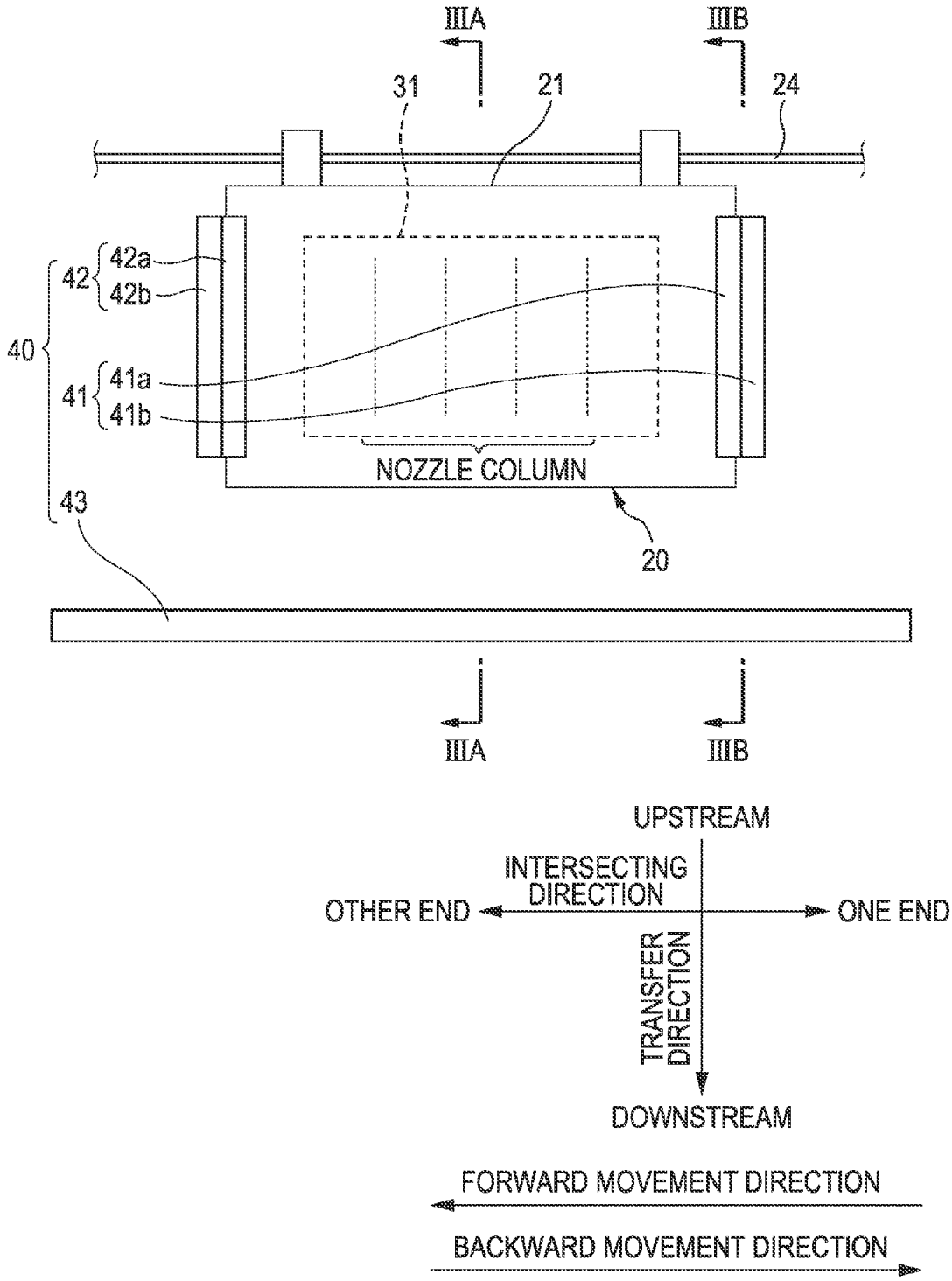
FIG. 2 is a schematic view showing a periphery of a head of the printer.
Figure 3A:
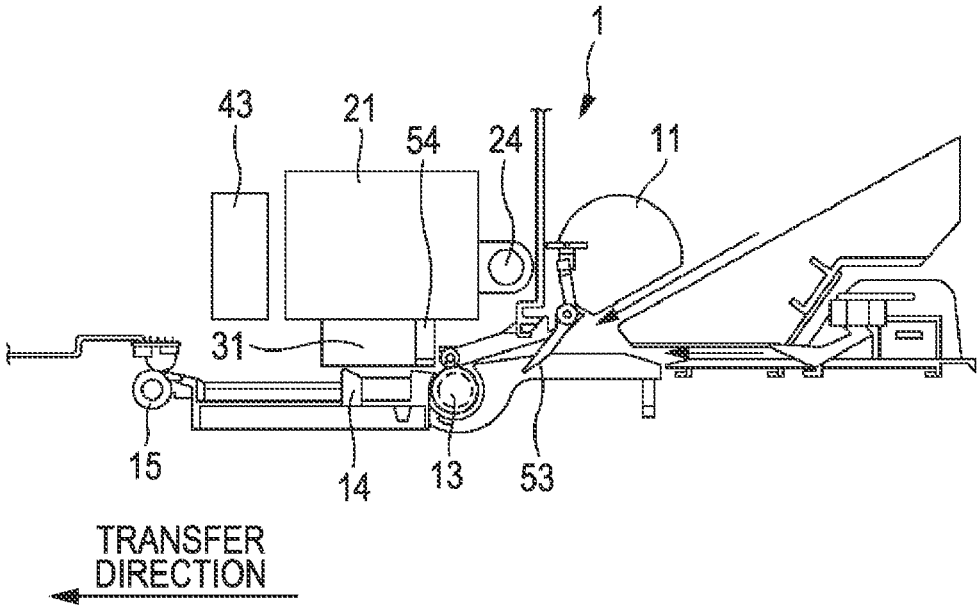
FIG. 3A is a cross sectional view of the printer.
Figure 3B:
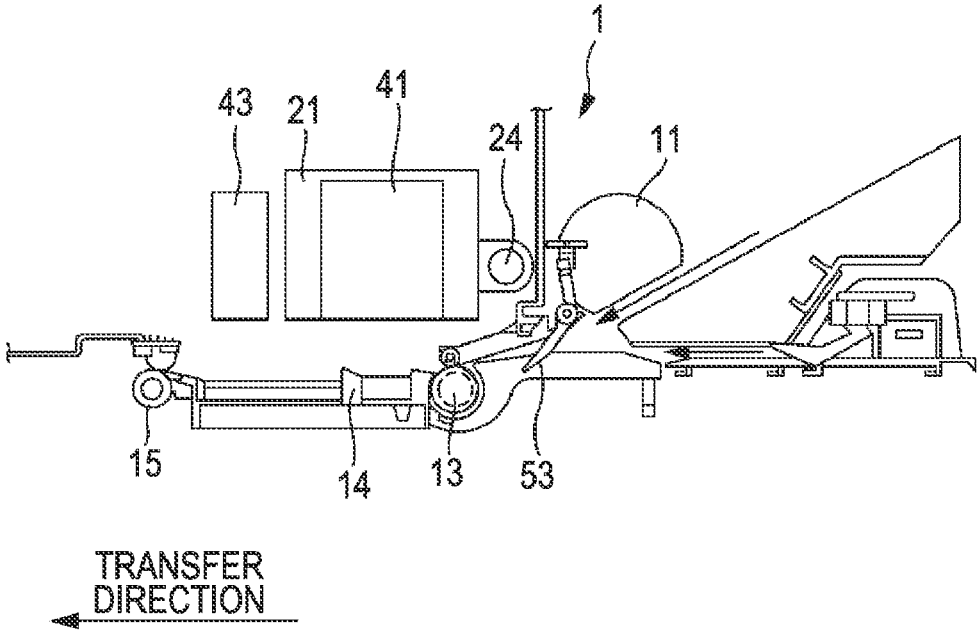
FIG. 3B is a cross sectional view of the printer.
Figure 4:
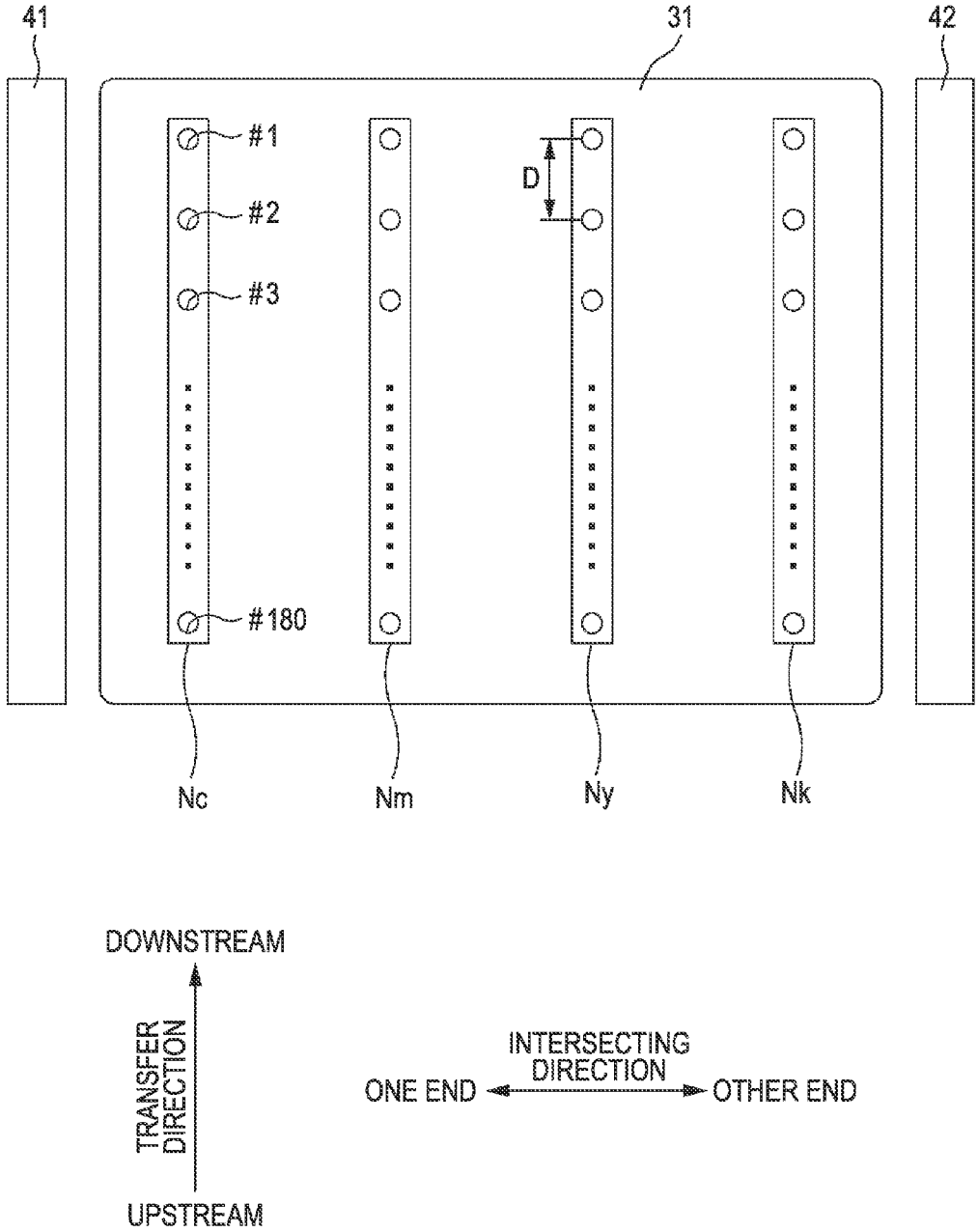
FIG. 4 is a view describing the constitution of the head.

Hereinbelow, an embodiment of the printing apparatus will be described referred to as in FIG. 1, FIG. 2, FIG. 3A, FIG. 3B and FIG. 4. FIG. 1 is a block diagram showing the constitution of the printer 1. FIG. 2 is a schematic view showing the periphery of the head of the printer 1. FIG. 3A and FIG. 3B are cross sectional views of the printer 1. FIG. 4 is a view describing the constitution of the head 31. Also, FIG. 3A is a view that is corresponding to the section IIIA-IIIA in FIG. 2, and FIG. 3B is a view corresponding to the section IIIB-IIIB in FIG. 2.

The printer 1 is an apparatus to print an image on a medium, by ejecting the ultraviolet curable ink (the UV ink, described below) which is an example of the electromagnetic wave curable ink that is cured by the irradiation of ultraviolet light (hereafter referred to as UV), as an the example of electromagnetic waves, toward the media such as paper and film sheet (hereafter referred to as the film). The UV ink is ink including an ultraviolet curable resin, and as receiving the UV irradiation, the ink is cured by the reaction of the photo polymerization of the ultraviolet curable resin. Also, the printer 1 of the embodiment prints the image using 4 colors UV ink of CMYK.

The printer 1 has a transfer unit 10, a carriage unit 20 as an example of a movement device, a head unit 30, an irradiation unit 40, a detector group 50, and a controller 60. The printer 1 that received the printing data from a computer 110 as an exterior apparatus, controls each unit (the transfer unit 10, the carriage unit 20, the head unit 30, and the irradiation unit 40) with the controller 60. The controller 60 controls each unit on the basis of the received printing data from the computer 110, and prints the image on the medium. The situation within the printer 1 is monitored by the detector group 50, and the detector group 50 outputs the detection result to the controller 60. The controller 60 controls each unit on the basis of the detection result that is outputted from the detector group 50.

The transfer unit 10 transfers the medium in the predetermined direction (hereafter referred to as the transfer direction). The transfer unit 10 has a paper feed roller 11, a transfer motor (not shown in the drawings), a transfer roller 13, a platen 14 and a discharge roller 15. The paper feed roller 11 is a roller that feeds the medium that has been inserted to the paper insert opening into the printer. The transfer roller 13 is a roller that transfers the medium which has been supplied by the paper feed roller 11 to a printable area, and the transfer motor drives the transfer roller 13. The platen 14 holds the medium during in printing. The discharge roller 15 is a roller that discharges the medium to the outside of the printer 1, and is provided on a downstream side of the transfer direction in the printable area.

The carriage unit 20 relatively moves a head 31 and irradiation sections 41 and 42 for provisional curing, as described below to the medium in the movement direction. More specifically, in the embodiment, the carriage unit 20 moves (referred to as "scan" as well) the head 31 and the irradiation sections 41 and 42 for provisional curing to the medium in intersecting directions that is crossed the transfer direction. The carriage unit 20 has a carriage 21 and a carriage motor (not shown in the drawings). Also, the carriage 21 maintains detachably the ink cartridge that contains the LTV ink. Thus, the carriage 21 is moved reciprocally along the guide shaft 24 by the carriage motor, in the state that the carriage 21 has been maintained on the guide shaft 24 that was crossed to the transfer direction.

Also, in the printer 1 of the embodiment, the relative moving velocity when the head 31 and the irradiation sections 41 and 42 for provisional curing are relatively moved to the medium, in other words the carriage moving velocity when the head 31 and the irradiation sections 41 and 42 for provisional curing are relatively moved to the medium is changed in two steps (for the sake of convenience of description, the high velocity Vh and low velocity Vl) in accordance by the control of the controller 60. Also, the description will be made below regarding the change of the carriage moving velocity (the basis that causes the carriage moving velocity to change, the reason that changes the carriage moving velocity or the like).

The head unit 30 ejects the UV ink onto the medium. The head unit 30 has a head 31 including a plurality of nozzles. The head 31 is provided on the carriage 21, so that when the carriage 21 moves in intersecting directions, the head 31 also moves in intersecting directions. Thus, the head 31 intermittently ejects the UV ink while moving in intersecting directions, so that dot line (raster line) is formed on the medium along the intersecting directions. Also, below, regarding the moving of the head 31, it said that a forward movement which is moving from one (first) end side to the other (second) end side, and it said that the backward movement which is moving from the second end side to first end side of FIG. 2. In the embodiment, the ejection of the UV ink is performed during the period of the forward movement and during the period of the backward movement. In other words, the printer 1 of the embodiment performs printing in dual direction.

The description will be made in below regarding the constitution of the head 31.

The irradiation unit 40 irradiates the UV to the UV ink that was attached elastically to the medium. The dot formed on the medium is cured when receives the VU irradiation from the irradiation unit 40. The irradiation unit 40 of the embodiment has irradiation sections 41 and 42 (corresponding to the irradiation section) for provisional curing that irradiates the UV on the UV ink that was ejected onto the medium by the head 31, so as to provisionally cure the UV ink, and the irradiation section 43 for final curing that irradiates the UV on the UV ink on the medium so as to finally cure the UV ink. Also, detailed description will be made in below regarding the irradiation sections 41 and 42 for provisional curing and the irradiation section 43 for final curing.

The detector group 50 includes a linear type encoder (not shown in the drawings), a rotary type encoder (not shown in the drawings), a paper detection sensor 53 and an optical sensor 54. The linear type encoder detects the position of the intersecting directions of the carriage 21. The rotary type encoder detects a rotation amount of the transfer roller 13. The paper detection sensor 53 detects the position of the tip end of the medium during the feed of the paper. The optical sensor 54 detects whether the medium is present by a light emitting section and a light receiving section attached on the carriage 21. Thus, the optical sensor 54 detects the end section position of the medium, while being moved by the carriage 21, and can detect the width of the medium. Also, the optical sensor 54 also detects the tip end (referred to as end section of the downstream side in the transfer direction, or as upper end as well) of the medium and the rear end (referred to as end section of the upstream side in the transfer direction, or as lower end as well) of the medium according to the situation.

The controller 60 is a control unit (control section) to control the printer 1. The controller 60 has an interface section 61, CPU 62, a memory 63 and a unit control circuit 64. The interface section 61 performs transmitting or receiving of the data between the computer 110 that is the exterior apparatus and the printer 1. The CPU 62 is a computing process apparatus for overall controlling of the printer 1. The memory 63 secures an area for working and an area for storing the program of the CPU 62, and has storage elements such as RAM and EEPROM. The CPU 62 controls each unit through the unit control circuit 64 in accordance with the program that is stored on the memory 63.

As described below, in printing, the controller 60 alternatively repeats the dot forming operation that ejects the UV ink from the head 31 moving in intersecting directions and the transfer operation that transfers the medium in the transfer direction, and prints the image which is constituted a plurality of dots on the medium. Also, the dot forming operation (the UV ink ejecting operation) hereafter referred to as "pass".

Regarding the Constitution of the Head 31

A plurality of the nozzles is provided in the lower surface of the head 31 for ejecting the UV ink. As shown in FIG. 4, the head 31 of the embodiment has a plurality of the nozzles per every ink color of CMYK. The plurality of the nozzles is posed in a line in the transfer direction with the predetermined nozzle pitch. As described above, the nozzle column Nc, Nm, Ny and Nk of every CMYK 4 colors are formed in the head 31.

In the embodiment, 180 nozzles are provided in line in the transfer direction with the nozzle pitch D (for example, 360 dpi) in each the nozzle column. Also, in the nozzle of the nozzle column, small number is attached on the nozzle of the downstream side in the transfer direction. In each nozzle, a piezoelectric element (not shown in the drawings) is provided as the driving element for ejecting the UV ink from each nozzle. The driving signal drives the piezoelectric element, so as to eject the droplet shaped LTV ink from each the nozzle. The ejected UV ink is attached elastically on the medium to form the dot.

Regarding the Provisional Curing and the Final Curing

In the embodiment, the UV is irradiated on the UV ink that is attached elastically onto the medium, so as to cure the dot. The printer 1 of the embodiment, includes the irradiation sections 41 and 42 for provisional curing that perform the UV irradiation for provisional curing the UV ink, and the irradiation section 43 for final curing that performs UV irradiation for the final curing as the irradiation unit 40, thus performing a two steps cure. Also, the provisional curing is to suppress the flow (spreading of the dot) of the LTV ink that is attached elastically onto the medium, and the final curing is to completely cure the UV ink. The irradiation amount per unit time that is the irradiation amount per unit time of the LTV irradiated on the UV ink and total irradiation amount that is the product of the irradiation amount per unit time and the irradiation time of the final curing are larger than those of the provisional curing (the irradiation amount per unit time is referred to as the irradiation amount, briefly hereinbelow). The irradiation sections 41 and 42 for provisional curing and the irradiation section 43 for final curing provide light sources to irradiate LTV to the medium respectively.

As shown in FIG. 2 and FIG. 4, the irradiation sections 41 and 42 for provisional curing are provided on the carriage 21 respectively. The irradiation section 41 for provisional curing is provided at one end side of the carriage 21 in intersecting directions, and the irradiation section 42 for provisional curing is provided at the other end side of the carriage 21 in intersecting directions. Thus, the head 31 and the irradiation sections 41 and 42 for provisional curing move in intersecting directions integrally, in accordance with the moving of the carriage 21. In other words, when the nozzle column of each color of the head 31 is reciprocally moved, the irradiation sections 41 and 42 for provisional curing are reciprocally moved, while maintaining relative position to the nozzle column of each color. At this time, the UV is irradiated from the irradiation sections 41 and 42 for provisional curing to the medium. Specifically, the UV is irradiated from the irradiation section 41 for provisional curing in the period of the forward movement, and the UV is irradiated from the irradiation section 42 for provisional curing in the period of the backward movement. As described above, the provisional curing is performed in the period that the head 31 moves in intersecting directions, and is performed with the pass which is the same as that of the dot formation.

In other words, the controller 60 of the embodiment causes the head 31 to perform the ejecting operation in which the UV ink is ejected onto the medium while causing the head 31 and the irradiation sections 41 and 42 for provisional curing to move forward (backward) moving to the medium, and continuously causes the irradiation section 41 for provisional curing (the irradiation section 42 for provisional curing) to perform the irradiation operation in which the UV is irradiated on the dot in the medium, in other words, the UV ink that was ejected onto the medium. Thus, the irradiation section 41 for provisional curing (the irradiation section 42 for provisional curing) has the predetermined width in the forward movement direction (the backward movement direction), so that the dot in the medium is irradiated by the irradiation section 41 for provisional curing during the predetermined period.

In the embodiment, the UV irradiation amount that is irradiated on the dot has different values in the first half of the period and in the second half of the period of the predetermined period. In other words, the dot in the medium is irradiated by the irradiation section 41 for provisional curing (the irradiation section 42 for provisional curing) during the predetermined period after the irradiation section 41 for provisional curing has been arrived on the upper parts of the dot in accordance with the forward movement (the backward movement) until the irradiation section 41 for provisional curing has been passed completely the dot, and the downstream portions of the irradiation section 41 for provisional curing in the forward movement direction (the downstream portions of the irradiation section 42 for provisional curing in the backward movement direction) irradiates in the first half period of the predetermined period, and the upstream portions of the irradiation section 41 for provisional curing in the forward movement direction (the upstream portions of the irradiation section 42 for provisional curing in the backward movement direction) irradiates in the second half period of the predetermined period. Thus, in the embodiment, as shown in FIG. 2, the irradiation section 41 for provisional curing (the irradiation section 42 for provisional curing) is separated in two sections of a first irradiation section for provisional curing and a second irradiation section for provisional curing which are provided along the movement direction, in other words, separated in the downstream side irradiation section 41*a* for provisional curing that is positioned on the downstream side in the forward movement direction and the upstream side irradiation section 41*b* for provisional curing that is positioned on the upstream side in the forward movement direction (the downstream side irradiation section 42*a* for provisional curing that is positioned in the downstream side of the backward movement direction and the upstream side irradiation section 42*b* for provisional curing that is positioned in the upstream side of the backward movement direction), and the UV intensity that is emitted from the downstream side irradiation section 41*a* for provisional curing (the UV intensity that is emitted from the downstream side irradiation section 42*a* for provisional curing) is different from the UV intensity that is emitted from the upstream side irradiation section 41*b* for provisional curing (the UV intensity that is emitted from the upstream side irradiation section 42*b* for provisional curing). Thus, the irradiation amount of the LTV that is irradiated on the dot has different values in the first half of the period and the second half of the period.

Furthermore, in the embodiment, the intensity of the UV that is emitted from the downstream side irradiation sections 41*a* and 42*a* for provisional curing, or the upstream side irradiation sections 41*b* and 42*b* for provisional curing are variable, so that the UV irradiation amount that is irradiated to the dot at the first half of the period and the second half of the period becomes variable respectively. Thus, the irradiation amount is variable by the control of the controller 60. In other words, the controller 60 changes the intensity of the UV that is emitted from the irradiation sections 41 and 42 for provisional curing (specifically, the downstream side irradiation sections 41*a* and 42*a* for provisional curing and the upstream side irradiation sections 41*b* and 42*b* for provisional curing) so that the irradiation amount is changed. Also, the description will be made hereinbelow regarding the change of the irradiation amount (how the irradiation amount changes, how the irradiation amount changes based on any reason, and the reason the irradiation amount changes).

The irradiation section 43 for final curing is provided at the downstream side lower than the head 31 in the transfer direction, and the length thereof in intersecting directions is longer than the width of the medium that is to be a printing object. Thus the irradiation section 43 for final curing irradiates the UV toward the medium without being moved. According to the constitution, when the medium on which the dot was formed by the pass is transferred to the below of the irradiation section 43 for final curing by the transfer operation, the medium receives the UV irradiation from the irradiation section 43 for final curing.

Also, the irradiation by the irradiation section 43 for final curing may be performed when the medium has reached in the irradiation section 43 for final curing by the transfer operation that performs passing and the transferring alternatively, or also may be performed when the medium has reached the irradiation section 43 for final curing by transfer operation that discharges the medium, after the irradiation section 43 for final curing is in further downstream in the transfer direction and a predetermined printing such as one page is completed.

Also, in the embodiment, a light emitting diode (LED) is used as the light source of the irradiation sections 41 and 42 for provisional curing. The LED controls the size of the input current, so that the irradiation amount can be changed easily. Also, as the light source of the irradiation section 43 for final curing, a lamp (metal halide lamp, mercury lamp, and the like) is used.

Regarding the Printing Operation

The printer 1 of the embodiment performs a so-called interlace printing. The controller 60 performs the process of each unit of the printer 1 as described below, when the interlace printing is performed on the basis of the received printing data from the computer 110.

First of all, the controller 60 rotates the paper feed roller 11, and transfers the medium to be printed to the transfer roller 13. Next, the controller 60 drives the transfer motor (not shown in the drawings), so as to rotate the transfer roller 13. When the transfer roller 13 rotates by a predetermined rotation amount, the medium is transferred by a predetermined transfer amount.

When the medium is transferred to the lower parts of the head 31, the controller 60 controls the carriage unit 20, so as to rotate the carriage motor. In accordance with the rotation of the carriage motor, the carriage 21 moves in intersecting directions (specifically, the forward movement). Also, since the carriage 21 moves, the head 31 and the irradiation sections 41 and 42 for provisional curing which are provided on the carriage 21 also move in intersecting directions as well. While the head 31 and the irradiation sections 41 and 42 for provisional curing move (forward movement), the controller 60 causes the head 31 to intermittently eject the ink droplet, and causes the irradiation section 41 for provisional curing to perform the UV irradiation (the LTV irradiation from the irradiation section 42 for provisional curing does not perform). In other words, the controller 60 controls the carriage unit 20, the head 31 and the irradiation section 41 for provisional curing, so that the head 31 moves in the movement direction (the forward movement in the forward movement direction) to the medium, while performing the ejecting operation in which the LTV ink is ejected onto the medium and the irradiation section 41 for provisional curing moves in the movement direction (the forward movement in the forward movement direction) to the medium while performing the irradiation operation in which the UV is irradiated toward the UV ink on the medium.

Thus, the dot column in which a plurality of dots are positioned in line are formed in intersecting directions due to the UV ink ejecting operation and the irradiation operation for a first pass.

Next, the controller 60 controls the transfer unit 10, so as to drive the transfer motor. The transfer motor generates a driving force in the rotational direction in accordance with a driving amount that is instructed by the controller 60. Thus, the transfer motor rotates the transfer roller 13 using the driving force. When the transfer roller 13 rotates by a predetermined rotation amount, the medium is transferred by a predetermined transfer amount.

Next, the controller 60 controls the carriage unit 20, so as to rotate the carriage motor. In accordance with the rotation of the carriage motor, the carriage 21 moves in intersecting directions (specifically, the backward movement). Also, since the carriage 21 moves, the head 31 and the irradiation sections 41 and 42 for provisional curing that are provided on the carriage 21 move in intersecting directions as well. The controller 60 causes the head 31 to intermittently eject the ink droplet and causes the irradiation section 42 for provisional curing to perform the UV irradiation (the irradiation section 41 for provisional curing does not perform the UV irradiation) while the head 31 and the irradiation sections 41 and 42 for provisional curing are moving (the backward movement). In other words, the controller 60 controls the carriage unit 20, the head 31 and the irradiation section 42 for provisional curing, so that the head 31 moves in the movement direction against the medium (the backward movement in the backward movement direction), while causing the head 31 to perform the ejecting operation in which the UV ink is ejected toward the medium, and causing the irradiation section 42 for provisional curing to move in the movement direction against the medium (the backward movement in the backward movement direction), then causes the irradiation section 42 for provisional curing to perform the irradiation operation in which the UV is irradiated to the UV ink on the medium.

Thus, the dot column in which a plurality of dots are positioned in line are formed in intersecting directions due to the UV ink ejecting operation and the irradiation operation for a second pass.

Hereinbelow, the controller 60 repeatedly performs the transfer of the medium, the UV ink ejection (of after a third pass) and the provisional curing process to the UV ink, so as to form the dot on each pixel of the medium.

Also, the medium is transferred by the transfer unit 10, so that the controller 60 controls the irradiation section 43 for final curing and the irradiation section 43 for final curing irradiates the UV to the UV ink, when the dot (the UV ink) on the medium is arrived at the lower parts of the irradiation section 43 for final curing. Thus, the final curing of the UV ink is performed as described above.

The discharge roller 15 discharges the medium on which the printing is finished.

As described above, the image is printed on the medium.

Regarding a Plurality of Printing Modes Having Different Glossiness

As described above, the description was made that the irradiation amount and the carriage moving velocity may be changed due to the controls of the controller 60. Thus, in the printer 1 of the embodiment, the controller 60 causes both the irradiation amount and the carriage moving velocity to change so that the glossiness of the printing image is changed, and thus a plurality of printing modes having different glossiness are performed. Now, the description will be made regarding the printing mode referred to FIG. 5. FIG. 5 is a view showing the relationship among the printing mode, the irradiation amount and the carriage moving velocity.

The printer 1 in accordance with the embodiment has a high gloss printing mode in which gloss image is obtained that the gloss of printing image is increased, and a low gloss printing mode in which matte image is obtained that the gloss of the printing image is decreased. Thus, the user can select any one of both the printing modes to be performed.

In other words, when the user selects a printing mode from the printer driver and the like within the computer 110, the information regarding the printing mode is written as the printing data. Thus, the printer 1 (the controller 60) that received the printing data (the information regarding the printing mode) performs the printing operation as described above, at this time, the printing mode which is selected by the user in both printing modes (referred to as selected printing mode as well) is performed on the basis of the information regarding the printing mode. Thus, the controller 60 changes the irradiation amount and the carriage moving velocity according to whether the selected printing mode is the low gloss printing mode or the high gloss printing mode, so as to perform either one (that is, the selected printing mode) of both printing modes. As described above in the embodiment, the irradiation amount and the carriage moving velocity may be changed in accordance with the printing modes, however the irradiation amount may be also changed according to the kind of medium.

Specifically, the description will be made referred to FIG. 5. As shown in FIG. 5, in the embodiment, in the case where the printing mode is low gloss printing mode and the kind of medium is paper, the controller 60 controls the downstream side irradiation sections 41*a* and 42*a* for provisional curing and the upstream side irradiation sections 41*b* and 42*b* for provisional curing so that the irradiation amount becomes a second high irradiation amount Rh2 in the first half of the period and becomes a first high irradiation amount Rh1 in the second half of the period (both Rh1 and Rh2 are values of the high irradiation amounts, and Rh1 is larger than Rh2), and controls the carriage unit 20 so that the carriage moving velocity becomes a high velocity Vh. Also, in the case where the printing mode is low gloss mode and the kind of medium is film, the controller 60 controls the downstream side irradiation sections 41*a* and 42*a* for provisional curing and the upstream side irradiation sections 41*b* and 42*b* for provisional curing, so that the irradiation amount becomes the first high the irradiation amount Rh1 in the first half of the period and becomes the second high irradiation amount Rh2 in the second half of the period, and controls the carriage unit 20 so that the carriage moving velocity becomes high speed Vh. Also, in the case where the printing mode is high gloss printing mode and the kind of medium is paper, the controller 60 controls the downstream side irradiation sections 41*a* and 42*a* for provisional curing and the upstream side irradiation sections 41*b* and 42*b* for provisional curing, so that the irradiation amount becomes a second low irradiation amount Rl2 in the first half of the period and becomes a first low irradiation amount Rl1 in the second half of the period (both Rl1 and Rl2 are values of the low irradiation amount, and Rl1 is larger than Rl2), and controls the carriage unit 20 so that the carriage moving velocity becomes a low speed Vl. Also, in the case where the printing mode is the high gloss printing mode and the kind of medium is film, the controller 60 controls the downstream side irradiation sections 41*a* and 42*a* for provisional curing and the upstream side irradiation sections 41*b* and 42*b* for provisional curing so that the irradiation amount becomes the first low irradiation amount Rl1 in the first half of the period and becomes the second low irradiation amount Rl2 in the second half of the period, and controls the carriage unit 20 so that the carriage moving velocity becomes the low speed Vl. Also, in the embodiment, the total irradiation amount, that is the product of the irradiation amount and the irradiation time will be the same in any case due to the control of the controller 60. In other words, the control is performed so that (Rh1+Rh2)/Vh=(Rl1+Rl2)/Vl is satisfied.

As described above, as in the case where the medium is film (corresponding to a first medium) and as in the case where the medium is paper (corresponding to a second medium), in the case where the medium is film, the intensity of the UV that is emitted from the irradiation sections 41 and 42 for provisional curing are to be different, so that the controller 60 causes the irradiation sections 41 and 42 for provisional curing (specifically, the downstream side irradiation sections 41*a* and 42*a* for provisional curing) to perform the irradiation operation, thus the irradiation amount initially becomes the first irradiation amount (the first high irradiation amount Rh1 in the low gloss printing mode, and the first low irradiation amount Rl1 in the high gloss printing mode), then causes the irradiation sections 41 and 42 for provisional curing (specifically, the upstream side irradiation sections 41*b* and 42*b* for provisional curing) to perform the irradiation operation so that the irradiation amount becomes the second irradiation amount which is smaller than the first irradiation amount (the irradiation amount becomes the second high irradiation amount Rh2 in the low gloss printing mode, and becomes the second low irradiation amount Rl2 in the high gloss printing mode). Meanwhile, in the case where the medium is paper the controller causes the irradiation sections 41 and 42 for provisional curing (specifically, the downstream side irradiation sections 41*a* and 42*a* for provisional curing) to perform the irradiation operation so that the irradiation amount initially becomes a third irradiation amount (the irradiation amount is the second high irradiation amount Rh2 in the low gloss printing mode, and becomes the second low irradiation amount Rl2 in the high gloss printing mode), then causes the irradiation sections 41 and 42 for provisional curing (specifically, the upstream side irradiation sections 41*b* and 42*b* for provisional curing) to perform the irradiation operation so that the irradiation amount becomes a fourth irradiation amount which is larger than the third irradiation amount (the irradiation amount becomes the first high irradiation amount Rh1 in the low gloss printing mode, and is the first low irradiation amount Rl1 in the high gloss printing mode).

Thus, as described above, the degradation of the image quality is appropriately suppressed. In other words, in the case that the kind of medium is film in which the ink easily spreads relatively, the permeation of the ink (so-called, bleed phenomenon) is preferentially suppressed, and the UV irradiation is initially performed with the relatively large irradiation amount (in other words, the first irradiation amount). Thus, after that, changed to that the UV irradiation is performed with the relatively small irradiation amount (in other words, the second irradiation amount), so that spreading of the ink is secured to some extent, and generation of the phenomenon where the dot diameter or the line width become too small (the phenomenon that desired dot diameter or line width is not obtained) is suppressed. Meanwhile, in the case that the kind of medium is paper in which the ink does not relatively easily spread, the ink spreads, and the phenomenon that the dot diameter or the line width becomes too small is preferentially suppressed immediately, the UV irradiation is initially performed with the relatively small irradiation amount (in other words, the third irradiation amount). Thus, after that, changed to that the UV irradiation is performed with the relatively large irradiation amount (in other words, the fourth irradiation amount), and the generation of the ink permeation (so-called, bleed phenomenon) is suppressed. As above described, in accordance with the embodiment, even on any media, the bleed phenomenon and the phenomenon that the dot diameter or the line width becomes too small are appropriately suppressed, thus the degradation of the image quality is also appropriately suppressed.

Furthermore, in the case where the selected printing mode is the low gloss printing mode, the controller 60 controls the irradiation sections 41 and 42 for provisional curing and the carriage unit 20 and performs the low gloss printing mode, so that the irradiation amount and the carriage moving velocity becomes the high irradiation amount (in other words, the first high irradiation amount Rh1 and the second high irradiation amount Rh2) and the high velocity Vh, respectively, and in the case where the selected printing mode is the high gloss printing mode, controls the irradiation sections 41 and 42 for provisional curing and the carriage unit 20 and performs the high gloss printing mode so that the irradiation amount and the carriage moving velocity become the low irradiation amount (in other words, the first low irradiation amount Rl1 and the second low irradiation amount Rl2) and low velocity Vl, respectively.

Thus, in the case that the selected printing mode is the high gloss printing mode, the total irradiation amount is the same as the low gloss printing mode, and the provisional curing of the UV ink is performed slowly with the low irradiation amount. For that reason, in this case, the LTV ink spreads and becomes smoothing (leveling), the gloss of the printing image increases (the gloss image is obtained). Meanwhile, in the case that the selected printing mode is the low gloss printing mode, the provisional curing of the LTV ink is performed with the high irradiation amount and in a short time. For that reason, in this case, the smoothing of the UV ink is not promoted, the presence of the meniscus in the image is noticeable, and the gloss of the printing image is suppressed (the matte image is obtained). As described above, in the embodiment, the printing images that have different glossiness can be realized easily and appropriately.

Also, in the embodiment, when the user selects the kind of medium from the print driver or the like within the computer 110, the information of the kind of medium writes in the printing data, and the controller 60 receives the printing data (the information of the kind of medium) so that the kind of medium can be identified, however it is not limited to this, and the printer 1 (the controller 60) may be also identified automatically the kind of medium by the sensor.

Regarding the Modified Example

Figure 6:
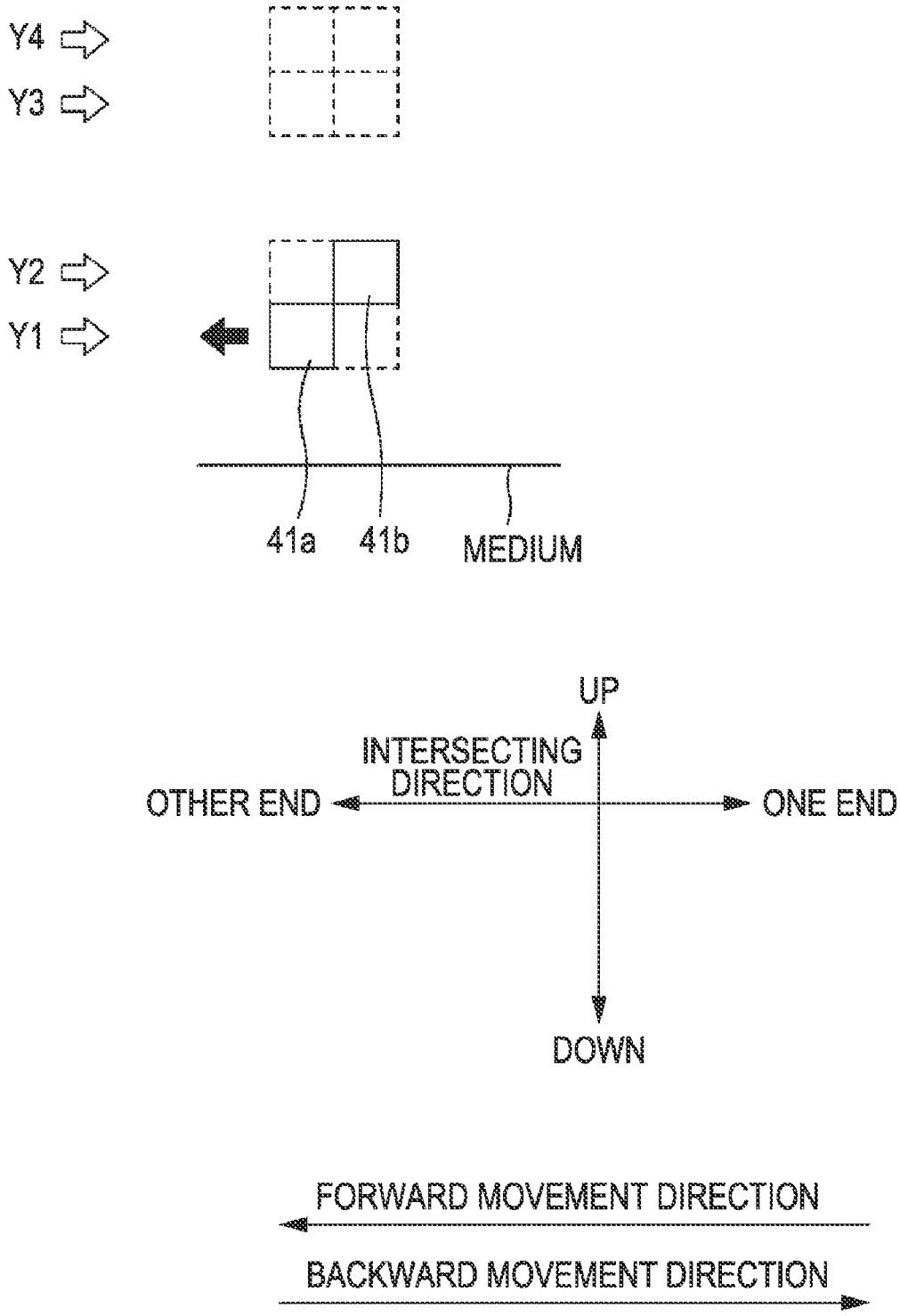
FIG. 6 is a schematic view showing an irradiation section for provisional curing of a first modified example.
Figure 7:
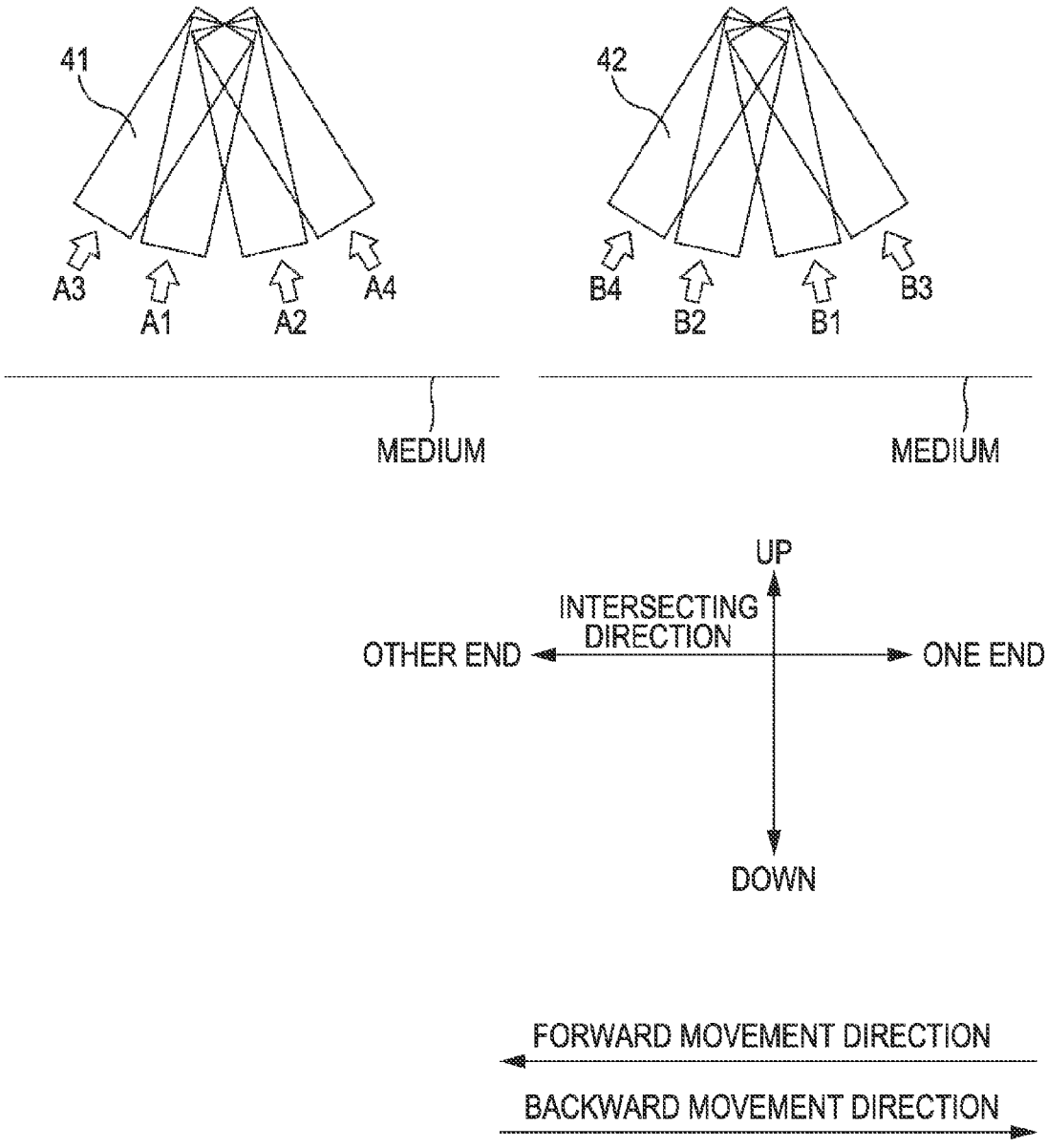
FIG. 7 is a schematic view showing an irradiation section for provisional curing of a second modified example.

In the above description, in the case where the medium is film the controller 60 of the embodiment causes the irradiation sections 41 and 42 for provisional curing to perform the irradiation operation so that the irradiation amount initially becomes the first irradiation amount, then causes the irradiation sections 41 and 42 for provisional curing to perform the irradiation operation so that the irradiation amount becomes the second irradiation amount which is smaller than the first irradiation amount, while in the case where the medium is paper, the controller 60 causes the irradiation sections 41 and 42 for provisional curing to perform the irradiation operation so that the irradiation amount initially becomes the third irradiation amount, then, causes the irradiation sections 41 and 42 for provisional curing to perform the irradiation operation so that the irradiation amount becomes the fourth irradiation amount which is larger than the third irradiation amount, however the embodiment is not limited to above description, other examples may be considered. Regarding the other examples, the two embodiments (a first modified example and a second modified example) will be described referring to FIG. 6 and FIG. 7. FIG. 6 is a schematic view showing the irradiation section for provisional curing of the first modified example. FIG. 7 is a schematic view showing the irradiation section for provisional curing of the second modified example. Also, for convenient of description, the embodiment that was described above is the first embodiment, and the first modified example and the second modified example which are described in below are the second embodiment and the third embodiment, respectively.

Regarding the Second Embodiment

The controller 60 of the second embodiment, controls the downstream side irradiation sections 41*a* and 42*a* for provisional curing, the upstream side irradiation sections 41*b* and 42*b* for provisional curing and the carriage unit 20 so that the irradiation amount and the carriage moving velocity are the same that of the first embodiment as shown in FIG. 5. Thus, in the first embodiment, the controller 60 changes the intensity of the UV which is generated by the downstream side irradiation sections 41*a* and 42*a* for provisional curing and the upstream side irradiation sections 41*b* and 42*b* for provisional curing so that the irradiation amount is changed, however in the second embodiment, the controller 60 changes the distance between the medium and the downstream side irradiation sections 41*a* and 42*a* for provisional curing and the upstream side irradiation sections 41*b* and 42*b* for provisional curing so that the irradiation amount is changed.

In other words, the intensity of the LTV that is generated in the downstream side irradiation sections 41*a* and 42*a* for provisional curing and the upstream side irradiation sections 41*b* and 42*b* for provisional curing are fixed (changing the intensity is impossible) in the second embodiment. Thus, as shown in FIG. 6 (only the downstream side irradiation section 41*a* for provisional curing and the upstream side irradiation section 41*b* for provisional curing are present, however the downstream side irradiation section 42*a* for provisional curing and the upstream side irradiation section 42*b* for provisional curing are also operated the same as that of those in FIG. 6), each downstream side irradiation sections 41*a* and 42*a* for provisional curing and the upstream side irradiation sections 41*b* and 42*b* for provisional curing can move in vertical direction respectively (in other words, distance to the medium may be changeable), the irradiation amount is changed by moving in vertical direction. In other words, when the controller 60 controls that the irradiation amount becomes the first high irradiation amount Rh1, the downstream side irradiation sections 41*a* and 42*a* for provisional curing or the upstream side irradiation sections 41*b* and 42*b* for provisional curing moves to the height of the white arrow Y1 as shown in FIG. 6, when the controller 60 controls that the irradiation amount becomes the second high irradiation amount Rh2, the downstream side irradiation sections 41*a* and 42*a* for provisional curing or the upstream side irradiation sections 41*b* and 42*b* for provisional curing moves to the height of the white arrow Y2 as shown in FIG. 6, when the controller 60 controls that the irradiation amount becomes the first low the irradiation amount Rl1, the downstream side irradiation sections 41*a* and 42*a* for provisional curing or the upstream side irradiation sections 41*b* and 42*b* for provisional curing move to the height of the white arrow Y3 as shown in FIG. 6, and when the controller 60 controls that the irradiation amount becomes the second low the irradiation amount Rl2, the downstream side irradiation sections 41*a* and 42*a* for provisional curing or the upstream side irradiation sections

41*b* and 42*b* for provisional curing move to the height of the white arrow Y4 as shown in FIG. 6.

As described above, as in the case where the medium is film and as in the case where the medium is paper, the controller 60 changes the distance between the irradiation sections 41 and 42 for provisional curing and the medium, in the case where the medium is film thus the controller 60 causes the irradiation sections 41 and 42 for provisional curing (specifically, the downstream side irradiation sections 41*a* and 42*a* for provisional curing) to perform the irradiation operation so that the irradiation amount initially becomes the first irradiation amount (the first high irradiation amount Rh1 in the low gloss printing mode and the first low gloss the irradiation amount Rl1 in the high gloss printing mode), then causes the irradiation sections 41 and 42 for provisional curing (specifically, the upstream side irradiation sections 41*b* and 42*b* for provisional curing) to perform the irradiation operation so that the irradiation amount becomes the second irradiation amount (the second high irradiation amount Rh2 in the low gloss printing mode, and the second low irradiation amount Rl2 in the high gloss printing mode) which is smaller than the first irradiation amount. Meanwhile, in the case where the medium is paper, the controller 60 causes the irradiation sections 41 and 42 for provisional curing (specifically, the downstream side irradiation sections 41*a* and 42*a* for provisional curing) to perform the irradiation operation so that the irradiation amount initially becomes the third irradiation amount (the second high irradiation amount Rh2 in the low gloss printing mode, and the second low irradiation amount Rl2 in the high gloss printing mode), then causes the irradiation sections 41 and 42 for provisional curing (specifically, the upstream side irradiation sections 41*b* and 42*b* for provisional curing) to perform the irradiation operation so that the irradiation amount becomes the fourth irradiation amount which is larger than the third irradiation amount (the first high irradiation amount Rh1 in the low gloss printing mode, and the first low irradiation amount Rl1 in the high gloss printing mode).

Also, as the selected printing modes are the case of the low gloss printing mode and the cases of the high gloss printing mode, the controller 60 causes the distance between the medium and the irradiation sections 41 and 42 for provisional curing to become different in the case where the selected printing mode is the low gloss printing mode, and controls the irradiation sections 41 and 42 for provisional curing so that the irradiation amount becomes the high irradiation amount (in other words, the first high irradiation amount Rh1 and the second high irradiation amount Rh2), and controls the irradiation sections 41 and 42 for provisional curing so that the irradiation amount becomes the low irradiation amount (in other words, the first low irradiation amount Rl1 and the second low the irradiation amount Rl2) in the case where the selected printing mode is the high gloss printing mode.

Thus, the second embodiment has superiority in that a simple member can be used as the irradiation section for provisional curing (in other words, as the irradiation section for provisional curing having a fixed intensity of generated UV), (while, the first embodiment has superiority in that the peripheral device of the irradiation section for provisional curing is simple (in other words, the device for moving the irradiation section for provisional curing is not necessary)).

Also, even in the second the embodiment, when the user selects the kind of medium from the printer driver and the like within the computer 110, the information of the kind of medium writes in the printing data, and the controller 60 receives the printing data (the information of the kind of medium) so that the kind of medium is identified, however this is not limited to the description above, and the printer 1 (the controller 60) can be also identified automatically the kind of medium by the sensor or the like.

Also, in the second the embodiment, as in the case where the medium is paper and as in the case where the medium is film, the distance between the downstream side irradiation sections 41*a* and 42*a* for provisional curing and the upstream side irradiation sections 41*b* and 42*b* for provisional curing may be also changed in the movement direction (the intersecting directions).

For example, as shown by the black arrows in FIG. 7, the downstream side irradiation sections 41*a* and 42*a* for provisional curing are constituted so as to move in intersecting directions. Thus, in the case where the medium is film, when the high gloss printing mode is selected, the positional relationship between the downstream side irradiation sections 41*a* and 42*a* for provisional curing and the upstream side irradiation sections 41*b* and 42*b* for provisional curing in intersecting directions is in the state as shown in FIG. 7 (in other words, in a state where the downstream side irradiation sections 41*a* and 42*a* for provisional curing and the upstream side irradiation sections 41*b* and 42*b* for provisional curing are adjacent in intersecting directions), however in the case where the medium is paper, the downstream side irradiation sections 41*a* and 42*a* for provisional curing are moved in black arrow direction, and the positional relationship between the downstream side irradiation sections 41*a* and 42*a* for provisional curing and the upstream side irradiation sections 41*b* and 42*b* for provisional curing in intersecting directions is in the state that the downstream side irradiation sections 41*a* and 42*a* for provisional curing and the upstream side irradiation sections 41*b* and 42*b* for provisional curing are separated.

In the case that the medium is paper, and the high gloss printing mode is selected, since the ink is not spread easily on the medium, the UV ink does not spread sufficiently (does not smoothing), and the glossiness of the printing image may not be high sufficiently, even though the provisional curing of the UV ink is performed slowly with the low irradiation amount.

Thus, in this case, when the downstream side irradiation sections 41*a* and 42*a* for provisional curing and the upstream side irradiation sections 41*b* and 42*b* for provisional curing are separated in intersecting directions, even in the case where the medium is paper in which the ink is difficult to spread, the gloss of the printing image becomes sufficiently high, because the time being taken from the start of the provisional curing of the LTV ink to the finish of the provisional curing of the UV ink by the downstream side irradiation sections 41*a* and 42*a* for provisional curing and the upstream side irradiation sections 41*b* and 42*b* for provisional curing is increased.

As described above, as in the case where the medium is paper and as in the case where the medium is film, when the controller 60 changes the distance of the downstream side irradiation sections 41*a* and 42*a* for provisional curing and the upstream side irradiation sections 41*b* and 42*b* for provisional curing in the movement direction (the intersecting directions), the glossiness of the printing image may become suitable. Also, the control can apply to the printer 1 of the first embodiment.

Regarding the Third Embodiment

The same as the first embodiment, the controller 60 of the third embodiment also controls the irradiation sections 41 and 42 for provisional curing and the carriage unit 20 so as to become the irradiation amount and carriage moving velocity as shown in FIG. 5 respectively. Thus, in the first embodiment, the irradiation sections 41 and 42 for provisional curing are separated to the downstream side irradiation sections 41*a* and 42*a* for provisional curing and the upstream side irradiation sections 41*b* and 42*b* for provisional curing, however in the third embodiment, those are not separated. Also, in the first embodiment, the controller 60 changes the irradiation amount by changing the intensity of the UV emitted from the downstream side irradiation sections 41*a* and 42*a* for provisional curing and the upstream side irradiation sections 41*b* and 42*b* for provisional curing, however in the third embodiment, the inclination of the irradiation sections 41 and 42 for provisional curing is changed so that the direction of the UV generated in the irradiation sections 41 and 42 for provisional curing is changed, and the irradiation amount is changed as well.

In other words, regarding the irradiation sections 41 and 42 for provisional curing in the third embodiment, the intensity of the generated UV is fixed (unchangeable). Thus, as shown in FIG. 7, the irradiation sections 41 and 42 for provisional curing can rotate respectively around a shaft along the transfer direction (vertical direction to the paper surface in FIG. 7) and the inclination of the irradiation sections 41 and 42 for provisional curing is changed due to the rotation. Thus, the inclination is changed so that the direction of the LTV that is generated by the irradiation sections 41 and 42 for provisional curing is changed, and the irradiation amount is changed. In other words, in the case that the kind of medium is paper and the printing mode is the low gloss printing mode, the controller 60 moves the irradiation sections 41 and 42 for provisional curing, so as to incline the irradiation sections 41 and 42 for provisional curing as shown in the white arrow A1, B1 in FIG. 7, in the case that the kind of medium is film and the printing mode is the low gloss printing mode, the controller 60 moves the irradiation sections 41 and 42 for provisional curing, so as to incline the irradiation sections 41 and 42 for provisional curing as shown in the white arrow A2, B2 in FIG. 7, in the case that the kind of medium is paper and the printing mode is the high gloss printing mode, the controller 60 moves the irradiation sections 41 and 42 for provisional curing, so as to incline the irradiation sections 41 and 42 for provisional curing as shown in the white arrow A3, B3 in FIG. 7, and in the case that the kind of medium is film and the printing mode is the high gloss printing mode, the controller 60 moves the irradiation sections 41 and 42 for provisional curing, so as to incline the irradiation sections 41 and 42 for provisional curing as shown in the white arrow A4, B4 in FIG. 7.

As described above, as the case that the medium is film, and as the case that the medium is paper, the controller 60 changes the inclination of the irradiation sections 41 and 42 for provisional curing so that the direction of the UV that is generated by the irradiation sections 41 and 42 for provisional curing is changed, in the case that the medium is film, the controller 60 causes the irradiation sections 41 and 42 for provisional curing to perform the irradiation operation so as the irradiation amount initially becomes the first irradiation amount (the first high irradiation amount Rh1 in the low gloss printing mode, and the first low irradiation amount Rl1 in the high gloss printing mode), then the controller 60 causes the irradiation sections 41 and 42 for provisional curing to perform the irradiation operation so that the irradiation amount becomes the second irradiation amount which is smaller than the first irradiation amount (the second high irradiation amount Rh2 in the low gloss printing mode, and the second low irradiation amount Rl2 in the high gloss printing mode). Meanwhile, in the case that the medium is paper, the controller 60 causes the irradiation sections 41 and 42 for provisional curing to perform the irradiation operation so that the irradiation amount initially becomes the third irradiation amount (the second high irradiation amount Rh2 in the low gloss printing mode, and the second low irradiation amount Rl2 in the high gloss printing mode), then the controller 60 causes the irradiation sections 41 and 42 for provisional curing to perform the irradiation operation so that the irradiation amount becomes the fourth irradiation amount which is larger than the third irradiation amount (the first high irradiation amount Rh1 in the low gloss printing mode, and the first low irradiation amount Rl1 in the high gloss printing mode).

Also, as the selected printing modes are the low gloss printing mode and the high gloss printing mode, the controller 60 changes the inclination of the irradiation sections 41 and 42 for provisional curing so that the direction of the UV that is generated by the irradiation sections 41 and 42 for provisional curing is changed, in the case that the selected printing mode is the low gloss printing mode, the controller 60 controls the irradiation sections 41 and 42 for provisional curing so that the irradiation amount becomes the high irradiation amount (in other words, the first high irradiation amount Rh1 and the second high irradiation amount Rh2), in the case that the selected printing mode is the high gloss printing mode, the controller 60 controls the irradiation sections 41 and 42 for provisional curing so that the irradiation amount becomes the low irradiation amount (in other words, the first low irradiation amount Rl1 and the second low irradiation amount Rl2).

Thus, the third embodiment has a priority in which single irradiation section for provisional curing is sufficient to work without providing a plurality of the separated irradiation sections for provisional curing.

Also, even in the third embodiment, when the user selects the kind of medium from the print driver or the like within the computer 110, the information of the kind of medium writes in the printing data, and the controller 60 receives the printing data (the information of the kind of medium) so that the kind of medium can be identified, however it is not limited to this, and the printer 1 (the controller 60) may be also identified automatically the kind of medium through a sensor or the like.

The Other Embodiment

The above embodiment mainly describes the printing apparatus, however the printing method and the like are also included. Also, the invention is not limited to the above embodiments which are provided to facilitate understanding of the invention. The invention is appreciated by those having skill in the art that changes and modifications may be made to the embodiments without departing from the scope and the sprit of the invention, and further the invention includes the equivalents thereof as well. Especially, the invention includes embodiments described below.

Also, in the above embodiments, the printing apparatus is embodied on the ink jet printer, however this is not limited to the above description, and the invention can also apply to other printing apparatus.

Also, in the above embodiments, the embodiments have provided the ultraviolet curable ink as the electromagnetic curable ink, however this description is not limited. For example, the invention may apply to ink that is cured by electromagnetic waves such as electron rays, x-rays, visible rays, infrared light and the like.

In the above described embodiments, the embodiments have provided the movement device that relatively moves the irradiation section for provisional curing against the medium, as an example of the movement device of the irradiation section for provisional curing; however, this description is not limited, the invention may provide an example of the movement device for the medium.

Also, in the above described embodiment, the description have been given in which the first medium is film and the second medium is paper, however the description is not limited, and the first medium and the second medium may be one of any type, if the second medium can spread more easily than the first medium.

Also, in the above described embodiment, it is not limited the medium that can be used in the printer 1 being any one of the first medium and the second medium. For example, the invention can be applied to the printer 1 that may print on cloth rather than paper as the first medium and film as the second medium.

Also, the printer 1 of the above described embodiment performs interlace printing. In other words, the invention is applied to the printing apparatus (serial printer in above description) that performs interlace printing, however this description is not limited to the above description. For example, the invention can be also applied to a serial printer or a line printer that does not perform a interlace printing.

However, the above described embodiment is preferable because the matte image is properly obtained by reason of the below description (conversely, in the case of a non-interlace printing, even though the low gloss printing mode is selected, the matte image is not easily obtained). In other words, in the case of the interlace printing, each UV ink on the adjacent pixel which are contiguous with each other may be ejected at a time interval (for example, in the case that after the UV ink (the first UV ink) was ejected on any pixel for a first pass, the UV ink (the second UV ink) is ejected on a pixel that is adjacent to the pixel following a second pass). Thus, in this case, a meniscus is easily formed on the image and an appropriate matte image is easily obtained because the first UV ink and the second UV ink are not connected easily due to the time interval. Meanwhile, in the case of non-interlace printing, each LTV ink on the adjacent pixel which is adjacent each other is ejected without time interval (in other words, instantly after the UV ink (the first LTV ink) is ejected on any pixel, the LTV ink (the second UV ink) is ejected on a pixel which is adjacent the pixel). Thus, it tends to adhere immediately after the first UV ink and the second UV ink are ejected, so that a meniscus is not easily generated on the image (the UV ink has a smooth appearance) and the matte image is not easily obtained. Above described embodiment is preferable since the matte image is obtained properly.

What is claimed is:

1. A printing apparatus including:

a head that ejects droplets of electromagnetic-wave-curable ink onto a medium;

an irradiation section that irradiates electromagnetic waves on the ink which is ejected onto the medium by the head to provisionally cure the ink; and a controller that controls the irradiation section so as to cause the irradiation section to perform an irradiating operation that irradiates electromagnetic waves to the ink on the medium, wherein in the case where the medium is a first medium, the controller causes the irradiation section to perform the irradiating operation to deliver a first irradiation amount to the ink on the first medium, and then to deliver a second irradiation amount to the ink on the first medium, is the second irradiation amount being smaller than the first irradiation amount, wherein in the case where that the medium is a second medium, the controller causes the irradiation section to perform the irradiating operation to deliver a third irradiation amount to the ink on the second medium, and then to deliver a fourth irradiation amount to the ink on the medium, is the fourth irradiation amount being larger than the third irradiation amount, and wherein the droplets ejected on the first medium spread farther than the droplets ejected on the second medium.

2. The printing apparatus according to claim 1, further including a movement device that moves the irradiation section or the medium relative to the other, wherein the controller controls the irradiation section and the movement device, so as to cause the irradiation section to perform the irradiating operation, such that each of the first, second, third and fourth amounts of irradiation is controlled by controlling the intensity of the electromagnetic waves emitted by the irradiation section.

3. The printing apparatus according to claim 2, wherein the controller makes the distance between the first irradiation section and the second irradiation section in the movement direction in the case where the medium is the first medium to be different from that in the case where the mediums is the second medium.

4. The printing apparatus according to claim 1, wherein the irradiation section has a movement device that moves the irradiation section or the medium relative to the other, wherein the controller controls the irradiation section and the movement device, so as to cause the irradiation section to perform the irradiating operation, such that each of the first, second, third and fourth amounts of irradiation is controlled by controlling a distance between the irradiation section and the medium.

5. The printing apparatus according to claim 1, further including a movement device that relatively moves the irradiation section in the movement direction to the medium, wherein the controller controls the irradiation section and the movement device so as to cause the irradiation section to relatively move in the movement direction to the medium, while causing the irradiation section to perform the irradiating operation, and wherein by changing the incline of the irradiation section and making the direction of the electromagnetic waves emitted from the irradiation section in the case where the medium is the first medium to be different from that in the case where the medium is the second medium, in the case where the medium is the first medium, the controller causes the irradiation section to perform the irradiating operation so that the irradiation amount becomes the first amount, then causes the irradiation section to perform the irradiating operation so that the irradiation amount becomes the second irradiation amount, and in the case where the medium is the second medium the controller causes the irradiation section to perform the irradiating operation so that the irradiation amount becomes the third irradiation amount, then causes the irradiation section to perform the irradiating operation so that the irradiation amount becomes the fourth irradiation amount.

6. The printing apparatus according to claim 1, further including a movement device that moves the irradiation section or the medium relative to the other, wherein the printing apparatus has a first gloss printing mode and a second gloss printing mode, a glossiness of a print image printed in the first gloss printing mode is lower than a glossiness of a print image printed in the second gloss printing mode, wherein a velocity of the movement device in the first gloss printing mode is higher than a velocity of the movement device in the second gloss printing mode, and wherein the first, second, third and fourth irradiation amounts delivered in the first gloss printing mode are respectively higher than the first, second, third and fourth irradiation amounts delivered in the second gloss printing mode.

7. The printing apparatus according to claim 1, further including a movement device that moves the irradiation section or the medium relative to the other in a movement direction, wherein the irradiation section has a first irradiation section and second irradiation section which are disposed along the movement direction, the first irradiation section being positioned closer to the head than the second irradiation section, wherein the first irradiation amount and the third irradiation amount are delivered by the first irradiation section, and wherein the second irradiation amount and the fourth irradiation amount are delivered by the second irradiation section.

8. The printing apparatus according to claim 7, wherein an intensity of the electromagnetic waves emitted by the first irradiation section is different than the intensity of the electromagnetic waves emitted by the second irradiation section.

9. The printing apparatus according to claim 7, wherein a distance between the first irradiation section and the medium is different than the distance between the second irradiation section and the medium.

10. The printing apparatus according to claim 1, wherein a total of the first irradiation amount and the second irradiation amount delivered is substantially equal to a total of the third irradiation amount and fourth irradiation amount delivered.

* * * * *